US010646878B1

(12) United States Patent
Chang

(10) Patent No.: US 10,646,878 B1
(45) Date of Patent: May 12, 2020

(54) ONE HUNDRED SHEET DUAL THROAT AUTO-FEED PAPER SHREDDER

(71) Applicant: Herman Chang, Rancho Dominguez, CA (US)

(72) Inventor: Herman Chang, Rancho Dominguez, CA (US)

( * ) Notice: Subject to any disclaimer, the term of this patent is extended or adjusted under 35 U.S.C. 154(b) by 197 days.

(21) Appl. No.: 15/605,866

(22) Filed: May 25, 2017

Related U.S. Application Data

(60) Provisional application No. 62/341,546, filed on May 25, 2016.

(51) Int. Cl.
*B02C 18/00* (2006.01)
*B02C 23/02* (2006.01)
*B02C 25/00* (2006.01)

(52) U.S. Cl.
CPC ..... *B02C 18/0007* (2013.01); *B02C 23/02* (2013.01); *B02C 25/00* (2013.01); *B02C 2018/0038* (2013.01); *B02C 2018/0046* (2013.01)

(58) Field of Classification Search
CPC ..... B02C 18/0007; B02C 2018/0046; B02C 2018/0038; B02C 25/00
USPC ..... 241/236, 100
See application file for complete search history.

(56) References Cited

U.S. PATENT DOCUMENTS

| | | | | |
|---|---|---|---|---|
| 4,893,759 | A * | 1/1990 | Mizobata | B02C 18/0007 241/100 |
| 5,188,301 | A * | 2/1993 | Hasegawa | B02C 18/0007 241/100 |
| 5,772,129 | A * | 6/1998 | Nishio | B02C 18/0007 241/30 |
| 7,228,235 | B2 | 6/2007 | Grzych et al. | |
| RE40,042 | E * | 2/2008 | Chang | B02C 18/0007 241/166 |
| 7,398,936 | B1 * | 7/2008 | Wang | B02C 18/0007 241/100 |
| 7,500,627 | B2 | 3/2009 | Park et al. | |
| 7,874,506 | B2 * | 1/2011 | Wang | B02C 18/0007 241/100 |
| 8,146,845 | B2 * | 4/2012 | Chen | B02C 18/0007 241/100 |
| 8,167,223 | B2 | 5/2012 | Jensen et al. | |
| 8,201,766 | B2 * | 6/2012 | Chen | B02C 18/0007 241/225 |
| 2010/0032505 | A1 * | 2/2010 | Jensen | B02C 18/0007 241/25 |

(Continued)

*Primary Examiner* — Faye Francis
(74) *Attorney, Agent, or Firm* — Stefan J. Kirchanski; Matthew J. Spark; Zuber Lawler & Del Duca LLP

(57) ABSTRACT

The paper shredder simultaneously shreds both manually inserted sheets of paper and sheets of paper that are placed in an auto-feeder input tray. Immediately above the shredding mechanism the input path is bifurcated. One branch extends essentially straight up from the blades and leads to a manual input slot. A second branch extends at an angle towards the rear of the shredder where an auto-feed roller lies at the bottom of an auto-feed slot. When a stack of paper is placed into the slot, the bottom of the stack rests against the auto-feed roller which grasps the top sheet and pulls it under the roller. The roller then pushes the sheet down the angled throat where a curved surface bends the sheet downwards and into the shredding mechanism.

4 Claims, 4 Drawing Sheets

(56) References Cited

U.S. PATENT DOCUMENTS

| | | | | |
|---|---|---|---|---|
| 2010/0181398 | A1* | 7/2010 | Davis | B02C 18/0007 241/36 |
| 2010/0327091 | A1* | 12/2010 | Ko | B02C 18/0007 241/25 |
| 2014/0061347 | A1* | 3/2014 | Chang | B02C 18/0007 241/282.1 |
| 2014/0263773 | A1* | 9/2014 | Barthel | B02C 18/0007 241/25 |

* cited by examiner

ONE HUNDRED SHEET DUAL THROAT AUTO-FEED PAPER SHREDDER

CROSS-REFERENCE TO PRIOR APPLICATIONS

The current application is the utility application version of provisional application 62/341,546 filed 25 May 2016 and claims the priority and benefit of that application; the content of which application is incorporated herein by reference.

U.S. GOVERNMENT SUPPORT

NA

BACKGROUND OF THE INVENTION

Area of the Art

The current invention is in the area of office machines and more specifically is directed to a novel auto-feeding paper shredder.

Description of the Invention

Although the world professes to be moving to the "paper-free" office and although emails often have a "Save a tree—Please don't print" banner. Most business operations continue to rely on paper. With the current lack of cyber-security wherein hackers seem to penetrate even super-secret government agencies, it is somewhat difficult (foolhardy?) to enforce total reliance on computer files. Nevertheless, paper copies are also far from secure. While diligent locking up of pages containing sensitive information can discourage leakage of confidential information, perhaps the greatest challenge to the printed document continues to be disposal. Sooner or later documents must be thrown away, and since it is impossible to equip each worksite with a furnace (not to mention the ensuing environmental problems) other means must be taken to render discarded documents illegible. The presently preferred means of achieving this is the ubiquitous paper shredder.

While there are a variety of slightly different devices presently available, they all work in more or less the same manner. A shredding mechanism is positioned adjacent to an input slot so that any papers inserted through that slot interact with the mechanism. In the most common configuration blades mounted to a pair of counter-rotating shafts pull in sheets of paper inserted between the blades and cut them into more or less tiny pieces. While it is theoretically possible to reassemble those pieces, doing so is essentially impossible. Hacking computers is a much more efficient way of stealing information than attempting to reassemble tiny bits of paper.

Many conventional paper shredders suffer from two related problems. First, the shredding capacity is limited by the need to keep equipment prices reasonable. While the units can easily handles a single or even 5-10 sheets of paper or more in some cases, if too many sheets are simultaneously fed to the shredder, the unit is likely to jam and/or overheat. This limitation on input sheet number leads to the second problem. Because of the limited shredding capacity, the user must stand at the machine and slowly feed it an acceptable number of paper sheets. This can be tedious at best and may result in the user simply giving up and tossing the confidential documents into the trash if there is a large number of sheets to be shredded.

Both of these problems can be solved by some sort of auto-feed device that feeds sheets of paper into the shredding mechanism at a fixed rate. The first problem is solved because the auto-feeder can be designed to never feed an excess number of sheets into the mechanism. The second problem is solved because the auto-feed mechanism can accept an entire stack of paper and shred it without any oversight by the user. Large, heavy duty auto-feed shredders such as the shredder disclosed in U.S. Pat. No. 8,074,912, are available; these devices are large units that accept a large stack of paper to be shredded. The stack is placed onto a pair of counter-rotating rollers and paper sheets are pinched in their middle by the rollers, drawn from the bottom of the stack and fed into a shredding mechanism located below the rollers. This design is not feasible for smaller, personal units both because of bulk and cost.

Numerous attempts have been made to provide a reliable auto-feed device adaptable to shredding waste documents for smaller, economical paper shredders. This has not been a trivial problem to solve. There are numerous designs for feeding paper sheets into printing or copying devices. Simple ink jet printers use a vertical or inclined tray that holds a relatively small number of sheets and rollers slide one sheet at a time from the stack into the printing mechanism. Laser printers and copiers use horizontal paper trays with a complex roller system that removes a single sheet at a time from the top of the stack and inserts it into the printer/copying mechanism. We are all familiar with how often these devices are subject to annoying paper jams. And these jams occur when the devices are carefully loaded with a ream or large stack of uniform paper. But a paper shredder does not have the luxury of working on carefully loaded uniform sheets. Instead, a stack of documents to be shredded will contain a variety of different weights of paper many of which will have been handled (and written on) so that they may be somewhat rumpled. There may also be stapled stacks of documents.

As a result, manufacturers have developed auto-feed devices that use rather complex mechanical arrangements in an attempt to overcome the difficulty of handling non-uniform sheets of paper. U.S. Pat. No. 7,500,627 uses an inclined paper tray and a spiked roller to pull the top sheet of the stack into the shredding mechanism. U.S. Pat. No. 7,288,235 uses a curved (as opposed to flat) paper tray and a moveable vacuum roller that is lowered onto the stack to grab the top sheet and then lifted to move the sheet into the shredding mechanism. U.S. Pat. No. 8,167,223 is similar in that it uses a roller with a "retaining" device such as vacuum. This roller is lowered to the top of a stack of papers and extracts a sheet for shredding. Because the rollers can hold onto and/or lift a sheet of paper, problems with lack of paper uniformity are at least partially overcome. Other similar designs are even more complex and include paper trays that move as part of the paper feed process. All of these designs lack the ability to quickly shred one or a few pieces of paper while the device is occupied with shredding a stack of papers. To ensure that the "special" papers are shredded, the user must interrupt the auto-feed shredding process and add the new sheets to the stack.

SUMMARY OF THE INVENTION

The compact paper shredder of the current invention is able to simultaneously shred both manually inserted sheets of paper and sheets of paper that are placed in an input tray from which an auto-feeder removes sheets and transports them to the shredding mechanism. The unit is configured as an ordinary paper shredder having a somewhat elongated rectangular profile. The shredding mechanism is at the top of the unit while the lower portion of the device is a waste bin that can be removed from the unit for emptying. The shredding mechanism consists of paired counter-rotating shafts that bear interdigitated shredding blades. Immediately above the shredding mechanism the input path (the "throat" of the shredder) is bifurcated. One branch of the throat extends essentially straight above the blades and leads to a manual input slot. There are photo sensors so that any paper inserted into the input slot interrupts a beam of light, thereby activating the shredder motor. The rotating shredding blades shred the paper and drop the shredded bits of paper into the waste bin.

A second branch of the throat extends at an angle towards the rear of the shredder where an auto-feed roller lies at the bottom of an auto-feed slot. A slanted paper guide (angled back from the rear edge of the shredder top) is formed by a hinged lid that also closes the top of the shredder when it is not in service. When a stack of paper is placed on the paper guide, the bottom of the stack extends into the auto-feed slot and rests against the auto-feed roller. When the paper is in this position, it interrupts the beam from a second set of photo sensors, thereby activating the shredding mechanism. A gear train causes the feed roller to rotate in a clockwise direction. The lower paper stack edge is slightly fanned out by its contact with the roller allowing the roller to grasp the top sheet and pull it under the roller. The roller then pushes the sheet down the angled throat where a curved surface bends the sheet downwards and into the shredding mechanism. As the sheet bends downwards, it interacts with the first set of photo sensors so as to keep the shredder activated even after the last sheet of paper leaves the auto-feeder.

The paper guide can be equipped with edge paper guides that interact with a smaller (than the lid) hinged flap that is folded up from the upper surface of the paper shredder to form an input pocket. The input pocket controls the stack and improves the stability of the stack's sliding into the auto-feed slot. When a stapled stack of papers is inserted with the stapled end distal to the paper shredder, the stack is so constrained that when each sheet is grabbed by the feed roller, the sheet is torn off the staple with no need for specialized staple removing mechanisms.

In addition, the arrangement of the branched throat and paper sensors allows a user to insert sheets through the manual input slot while the shredder is busy shredding a stack of papers that have been place into the auto-feed slot.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an economical and easy to operate auto-feed paper shredder that can readily accept single sheets while occupied shredding a stack of documents.

Figure 1:
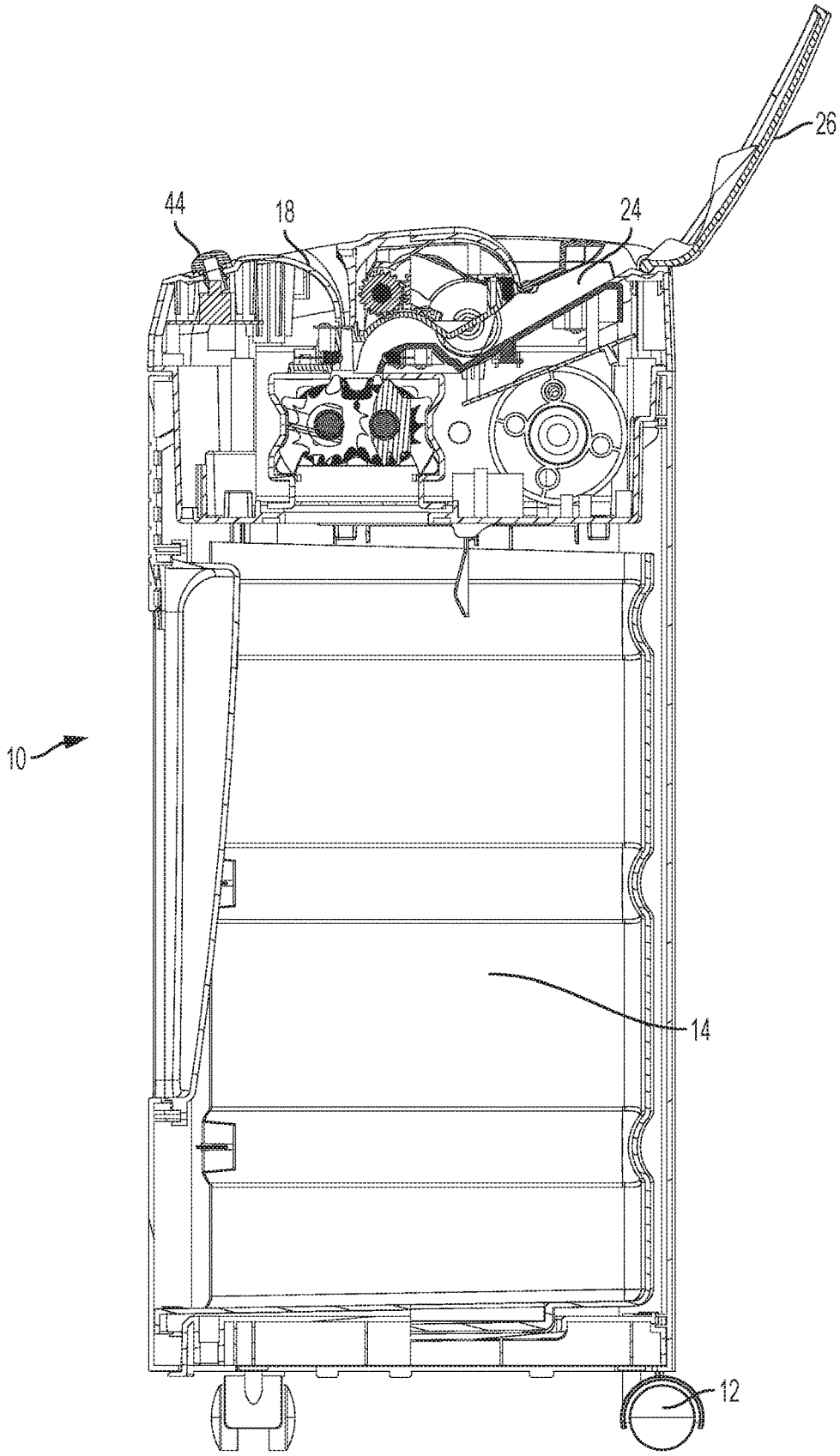
FIG. 1 shows a diagrammatic cross-section of the entire inventive shredder.
Figure 2:
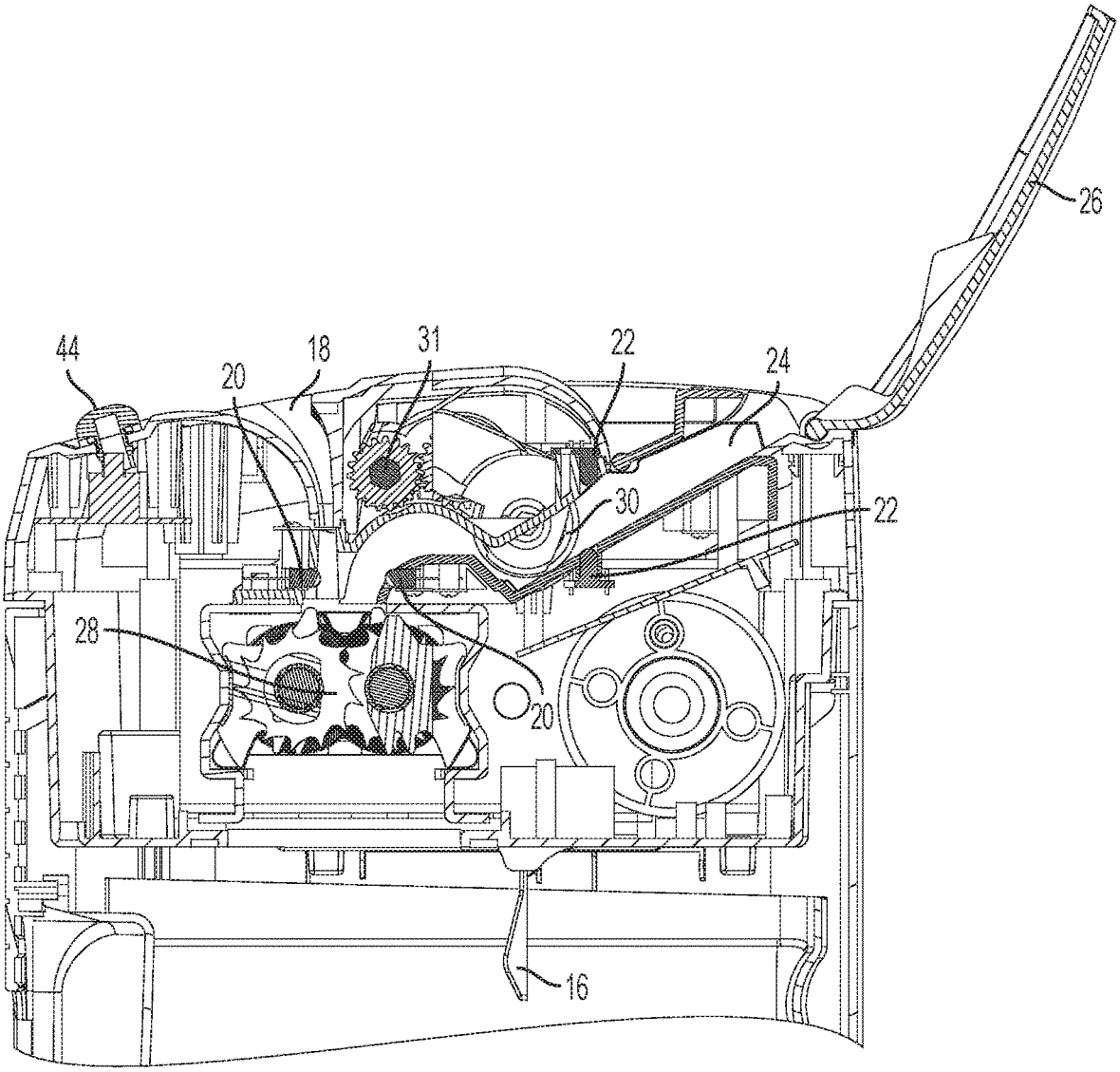
FIG. 2 shows a close-up view of the upper part of the shedder or FIG. 1 to show more detail.
Figure 3:
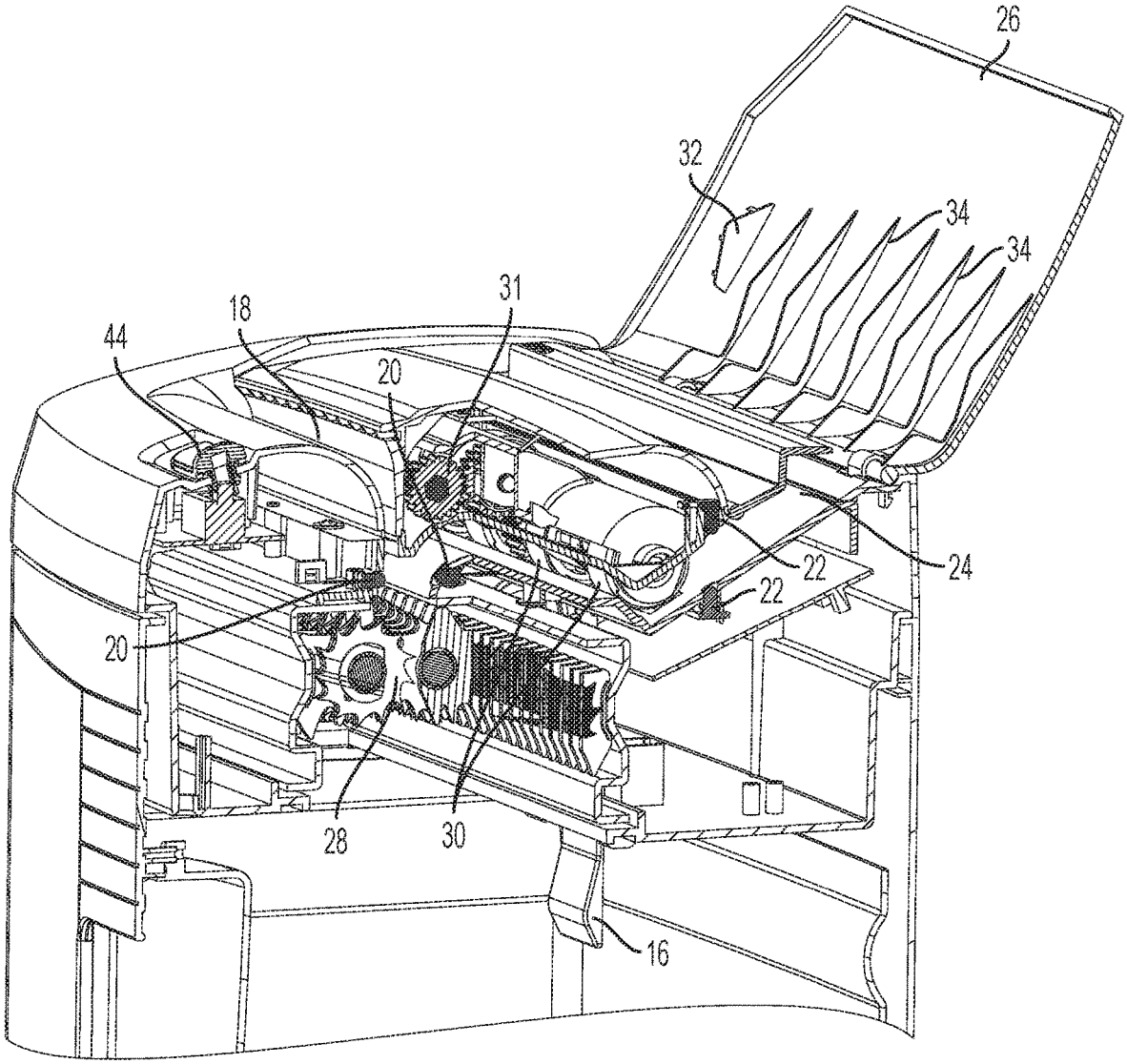
FIG. 3 is shows a close up right side perspective cut away and cross-section of the device of FIG. 1 to show additional mechanical detail

FIGS. 1, 2 and 3 are all drawings of cross-sections of the inventive shredder made along a plane running from the front to the back of the device. That is, the cross-sections show a side view of the mechanism. FIG. 3. is rendered in cut-away and perspective to reveal certain structures not as readily apparent in the "flat" cross-section of FIGS. 1 and 2. FIG. 1 shows a cross-section through the entire unit 10. The device has an elongated rectangular shape and most of the lower portion of the device is a hollow waste bin 14 into which the shredded paper bits fall. When the bin 14 becomes full, the paper shreds press against a full-bin sensor 16 and cut off power to the unit to prevent a backup of paper shreds into the shredding mechanism. The entire unit is supported by casters 12 so as to be easily rolled about.

The inventive paper shredder includes a normal shredding mechanism with blades 28 which is located in an upper portion of the unit above the waste bin 14. FIG. 2 shows an enlarged view of just the upper portion of the device. The shredding mechanism is accessed through a dual input (i.e., branched) throat. For storage purposes a hinged lid 26 folds over and closes (not shown) the top of the device. When in the open position as shown, the lid 26 serves as the support for a stack of papers to be shredded. A manual input slot 18, located on the front (left side in the drawing), leads directly (relatively straight shot) to the shredding mechanism in a manner similar to a conventional paper shredder. A second branch of the throat is the auto-feed throat 24 which is located to the rear of the unit (right side of drawing) and is associated with an auto-feed mechanism. A stack of paper (not shown) is slantingly supported by the lid 26 so that the lower end of the stack slides by gravity into the auto-feed throat 24. Paper guides 32 and 34 on the lid 26 reduce friction to facilitate sliding the stack into the throat 24.

The feed roller 30 of the auto-feed mechanism removes single or small number of sheets from the upper surface of the stack and delivers the sheets to the shredder mechanism. The "regular," manual input slot 18 is located at the front of the shredder 10. A slightly curved surface leads an inserted sheet (or sheets) of paper into a fairly broad, essentially straight, throat immediately above a pair of counter-rotating shafts equipped with shredding blades 28. A pair of optical sensors 20 face each other across the manual throat 18. These sensors detect the presence of a shreddable object in the throat and activate the shredding mechanism. Of course, sensors based on mechanical, acoustical or any other physical principle can be substituted. The rotating blades pull the paper in and shred it. The resulting fragments fall into the waste bin container 14 located below the shredding mechanism. After the paper clears the throat, the sensors are no longer activated, but a delay circuit ensures that the shredding mechanism continues to operate for a few additional seconds to allow all of the object to be completely shredded and fall into the waste bin 14.

The rear portion of the shredder (right side of the figures) contains an auto-feed mechanism. A hinged lid 26 acts as a paper support and paper guide into a slanted intake tray. A short paper guide 32 marks one edge of the paper stack; elongated paper guides 34 help guide the stack and facilitate sliding. When a stack of paper is inserted into the slanted tray, the distal end of the stack rests against the roller 30 in (FIG. 2). The roller 30 is driven by a gear train, one gear 31 of which is visible in the drawing. A pair of photo-sensors 22 are positioned to detect any paper resting against the roller 30. The presence of paper activates the shredding mechanism and the sheets of paper are pulled from the top of the stack and under the roller 30 which rotates in a clockwise direction. The clearance under the roller 30 is small and fixed and will accommodate only one or a very small number of sheets of paper. The intake tray 26 is sized to accommodate approximately 100 sheets of ordinary (20 pound) paper or about 0.4 inches (10 mm) in total thickness. Note that the shredder throat is branched with the branch coming from the manual input slot 18 joining with the branch coming from the auto-feeder input 24 immediately above the first pair of optical sensors 20. In this way the manual optical sensors 20 also detect paper coming in from the auto-feeder and keep the mechanism operating even after there is no paper left in the input tray 26 to activate sensors 22.

As the auto-feeder operates, it pulls the sheets from the top of the stack, one at a time, under the roller 30 and pushes them into the shredding mechanism 28. When the last sheet is removed from the stack, the auto-feed pair of optical sensors 22 no longer detect the presence of paper. However, paper is still detected by manual sensors 20 thereby ensuring that the delay timing does not initiate until the last bit of paper enter the shredding mechanism.

The shredding mechanism is designed to handle several sheets of paper simultaneously while the auto-feeder is designed to deliver single sheets to the shredding mechanism. Therefore, if papers are inserted through the main input slot while there is an active auto-feeding operation, the shredding mechanism is not overloaded. This is very convenient for the user because once an auto-feed job has started, it is possible to insert paper through the main input slot without interrupting the auto-feed job and without having to wait for the auto-feed job to complete.

Figure 6:
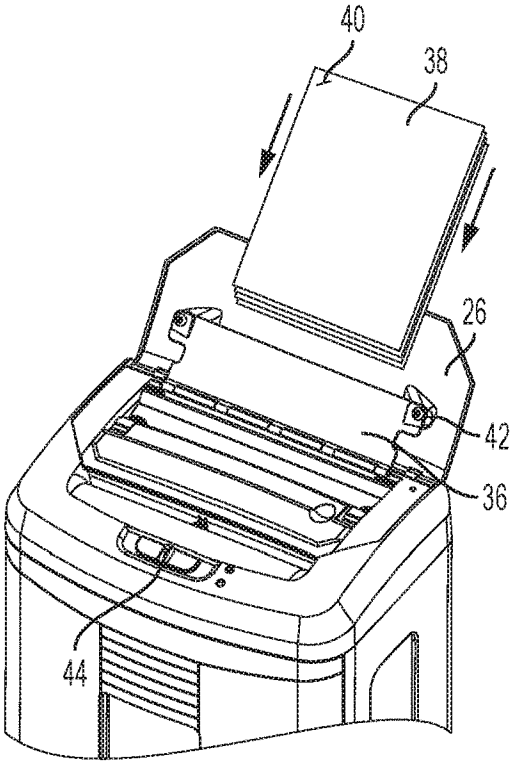
FIG. 6 is a view of the device of FIG. 4 in a third configuration where the top flap is in its fully extended position and interacting with the paper guards.
Figure 5:
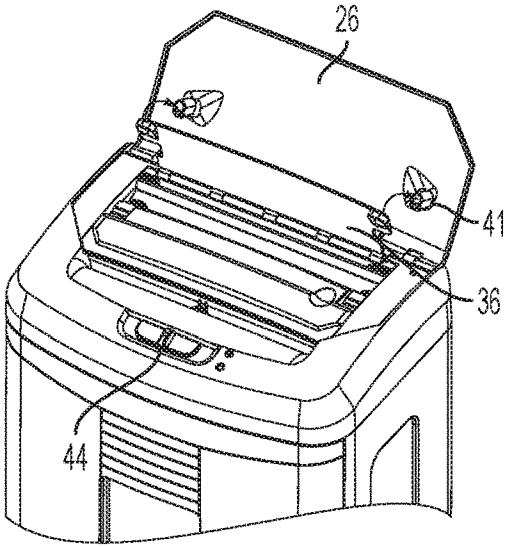
FIG. 5 is a view of the device of FIG. 4 in a second configuration where the top flap is in an intermediate position.
Figure 4:
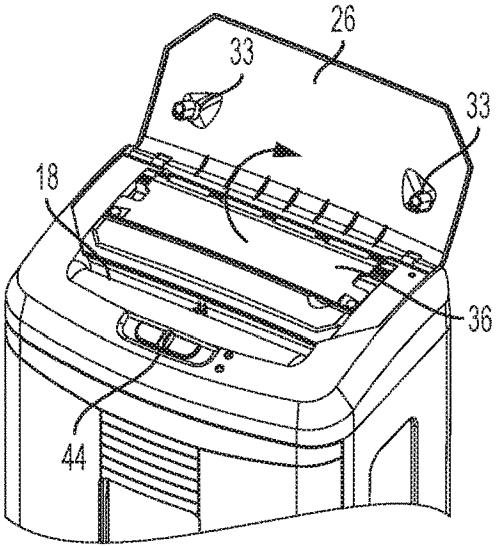
FIG. 4 is a view of the device of FIG. 1 equipped with paper pocket to facilitate shredding of stapled documents in a first view where a top flap is in its folded down position.

FIGS. 4, 5 and 6 show an improved paper guide system that can be used on the shredder 10. Here the short paper guide 32 and the long paper guides 34 have been replaced by two spaced-apart paper guides 33 that mark the lateral edges of the paper stack. An additional hinged top flap 36 has been added. After the shredder lid 26 is moved into an opened position (as shown in FIG. 4), the top flap 36 is rotated (arrow in drawing) towards the lid 25. FIG. 5 shows the top flap 36 in an intermediate position with small arrows showing the intended mating of top flap 36 with the paper guides 33. Finally (FIG. 6) when the top flap is rotated fully to meet the paper guides 33, a pocket-like tray is formed between the lid 26 and the top flap 36. Magnets 42 on the edge of the top flap interact with magnets 41 on the paper guides 33 to hold the top flap 36 firmly in place. Of course, other temporary fasteners such as snaps or locking tabs could be used in place of the magnets 42. The pocket-like tray provides improved paper feed as compared to the paper guides 32, 34 shown in FIG. 2. The pocket makes it easier to judge the thickness of the stack so as not to attempt to insert an overly thick stack. When a stapled stack of papers is inserted with the staple 40 distal to the shredder (as shown in FIG. 6) the auto-feeder very effectively rips one sheet at a time from the stack and feeds the sheet to the shredder. Without the pocket-like tray, the stack is more likely to bend or buckle, jamming the feeder rather than having a single sheet torn off. Other auto-feed paper shredders often include more or less complex staple strippers. Here the input tray arrangement ensures that the sheets are ripped off the staple one at a time without needing any complex mechanisms.

The shredding mechanism is advantageously equipped with the usual safety sensors that stop the operation if the unit becomes over heated and/or jammed. If a paper jam does occur, a reverse switch 44 is available that reverses the direction of the motor so that the jamming paper can be backed out of the mechanism. Note that the shredder throat is branched with an essentially straight branch leading to the manual input slot 18 and a curved branch leading to the auto-feed input 24. Therefore, when the unit is reversed, the backed paper comes out of the input slot (straight shot) and not out of the auto-feeder throat. It may be preferable, but not essential, to prevent the auto-feeder mechanism from feeding paper sheets in a reverse direction when the shredder is reversed. This can be achieved in several different ways. For example, the gear train can be equipped with a one-way clutch so that the feed roller 30 will not rotate in a reverse direction when the motor reverses. Even if the feed roller 30 rotates in a reverse (counterclockwise) direction, only a single sheet is pushed back onto the stack. Thereafter, the roller 30 simply rotates against the lower edge of the paper stack 38 without gripping a sheet—that is the configuration acts almost like a one-way clutch.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. A branched throat auto-feed paper shredder comprising:

a motor-driven shredding mechanism accessible by a branched throat;

a input slot leading to a first branch of said throat which feeds down to said shredding mechanism;

a first sensor which detects paper in the first branch and activates the shredding mechanism;

a second branch of said throat joining the first branch above the first sensor and being curved or angled and leading to an auto-feed input;

a hinged lid that covers a top of said paper shredder when said lid is in a closed position;

a hinged top flap that is revealed when said lid is in an open position;

a paper pocket for holding a paper stack to be shredded, said pocket comprising:

said lid in an open position wherein said lid forms a slanted input guide to said auto-feed input; and said top flap rotated to interact with the hinged lid;

an input roller disposed at a lower end of said pocket so that when a stack of papers is inserted into said pocket, ends of the papers rest against the input roller; and a second sensor for detecting paper in the said pocket thereby activating the shredding mechanism when paper is detected so that the input roller rotates and pulls a top sheet of paper under the roller and pushes the top sheet into the second branch of the throat where said sheet of paper curves downward to interact with the shredding mechanism and is shredded.

2. The auto-feed paper shredder of claim 1, wherein a delay circuit keeps the shredding mechanism activated for a predetermined period after the first sensor no longer detects paper.

3. The auto-feed paper shredder of claim 1 further comprising a reverse control which reverses the shredding mechanism causing jammed paper to emerge from the conventional input slot.

4. The auto-feed paper shredder of claim 1, wherein the hinged top flap interacts magnetically with the hinged lid.

* * * * *